US006030256A

United States Patent [19]

Cappe

[11] Patent Number: 6,030,256

[45] Date of Patent: Feb. 29, 2000

[54] ELECTRICAL CONNECTOR WITH CODING

[75] Inventor: Patrice Cappe, Faverolles, France

[73] Assignee: Framatome Connectors International, Courbevoie, France

[21] Appl. No.: 09/098,994

[22] Filed: Jun. 17, 1998

[30] Foreign Application Priority Data

Jun. 24, 1997 [FR] France ..... 97 07838

[51] Int. Cl.[7] ..... H01R 13/40

[52] U.S. Cl. ..... 439/598; 439/680; 439/902

[58] Field of Search ..... 439/598, 680, 439/681, 701, 902

[56] References Cited

U.S. PATENT DOCUMENTS

| | | | |
|---|---|---|---|
| 5,178,561 | 1/1993 | Lindeberg | 439/681 |
| 5,460,548 | 10/1995 | Roth | 439/680 |
| 5,549,488 | 8/1996 | Berndt | 439/680 |

FOREIGN PATENT DOCUMENTS

| | | |
|---|---|---|
| 3537722 | 4/1987 | Germany . |
| 8714016 U | 1/1988 | Germany . |
| 4439673 | 5/1996 | Germany . |
| 19513583 | 10/1996 | Germany . |

*Primary Examiner*—Neil Abrams
*Assistant Examiner*—Javaid Nasri
*Attorney, Agent, or Firm*—Perman & Green, LLP

[57] ABSTRACT

The connector is intended to be plugged into a complementary connector. It comprises a casing (10) having two side walls (16) defining a corridor, transverse to the plug-in direction and at least one contact-carrying module (12) which can be inserted into the corridor and defines a row of cavities for receiving contact terminals. A window (20) is made in at least one of the walls and a flank of the module carries a projecting coding key (38) which is oriented parallel to the plug-in direction and is placed so as to lie in the window when the module is in place.

10 Claims, 4 Drawing Sheets

ELECTRICAL CONNECTOR WITH CODING

FIELD OF THE INVENTION

The present invention relates to connectors intended to be plugged into a complementary connector, of the type comprising a casing having two side walls defining a corridor, transverse to the plug-in direction, and at least one contact-carrying module which can be inserted into the corridor and defines at least one row, parallel to the direction of insertion, of cavities for receiving contact terminals. The module and the casing generally include engaging means for holding the module in the fully engaged position in the casing, as described, for example, in Patent DE 35 37 722.

BACKGROUND OF THE INVENTION

Often several connectors of the same type are used in the same equipment. When, for example, cable bundles for vehicles are manufactured, the junctions between the terminals of each module and the conductors of the corresponding cable are made and then each module is inserted into a module holder in order to constitute a connector, which is generally a plug. In order to prevent a plug from being placed in a socket of the vehicle's equipment which is not that intended to receive it, means, called coding or polarizing means, are generally provided on each connector. These means include at least one key on one of the connectors, for example the plug, and a groove in the other connector, for example the socket, for receiving the key. Only two connectors for which the key and the groove occupy corresponding positions may thus be mated.

In current connectors of this type, it is the module-carrying casing which is provided with a coding key or keys. Consequently, there remains a risk of putting a module into a casing which is not the correct one. In addition, this makes it necessary to provide the same number of examples of module-carrying casings as there are examples of codings provided.

The present invention is intended in particular to provide a connector which meets the practical requirements better than those previously known, especially in that it removes the above drawbacks.

For this purpose, the invention provides a connector of the above-defined type, characterized in that a window is made in at least one of the said walls of the casing and in that one of the flanks of the module carries a projecting coding key which is oriented parallel to the plug-in direction and is placed so as to project into the window when the module is in place.

In order to allow the module to be plugged in, the window will generally extend as far as the front end of the casing, passing through the bottom of the latter.

Even when the module holder is held in the casing once the connector has been engaged in a complementary connector, it is desirable to provide means for holding the module in place although the connector has not been plugged in. This result may be achieved, in particular, by limiting the window, at the rear, in the plug-in direction by part of the wall of the casing which constitutes a flexible beam or transverse member having, on its internal face, a locking lug which engages with a projection provided on the flank of the module.

In order to allow entry of the key, the side wall of the casing in which the window (24) is made may include a step of height corresponding to the projection of the key of the module, above the level of the beam. The module may then have, to the rear, in the direction of insertion, an excrescence of height corresponding to that of the step.

The above characteristics, as well as others, will become more apparent on reading the description which follows of particular embodiments. The description refers to the drawings which accompany it, in which:

DETAILED DESCRIPTION OF THE PREFERRED EMBODIMENT

Figure 1:
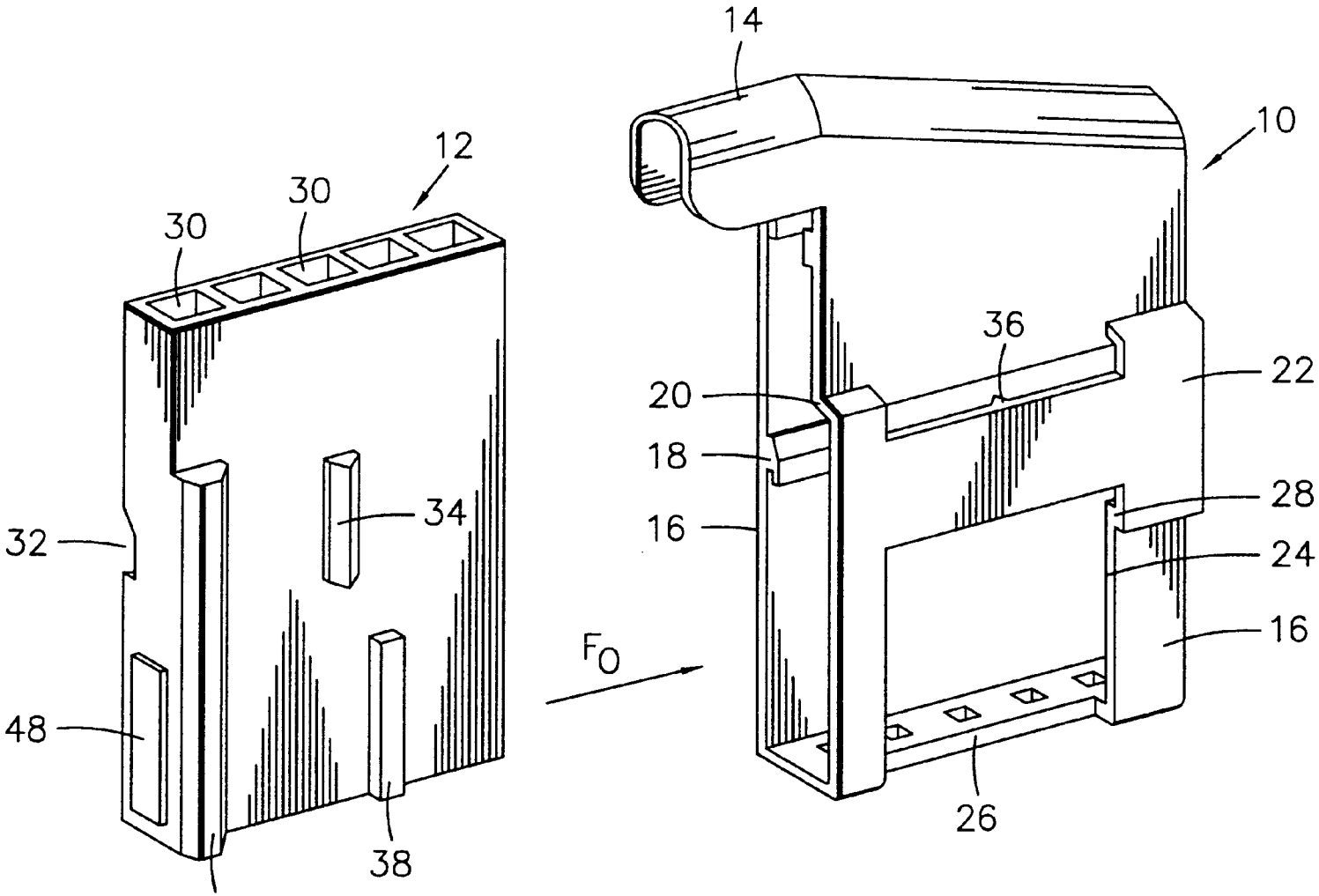
FIG. 1 is an exploded view, in perspective, showing the casing and the module of a connector, these being placed side by side.
Figure 2:
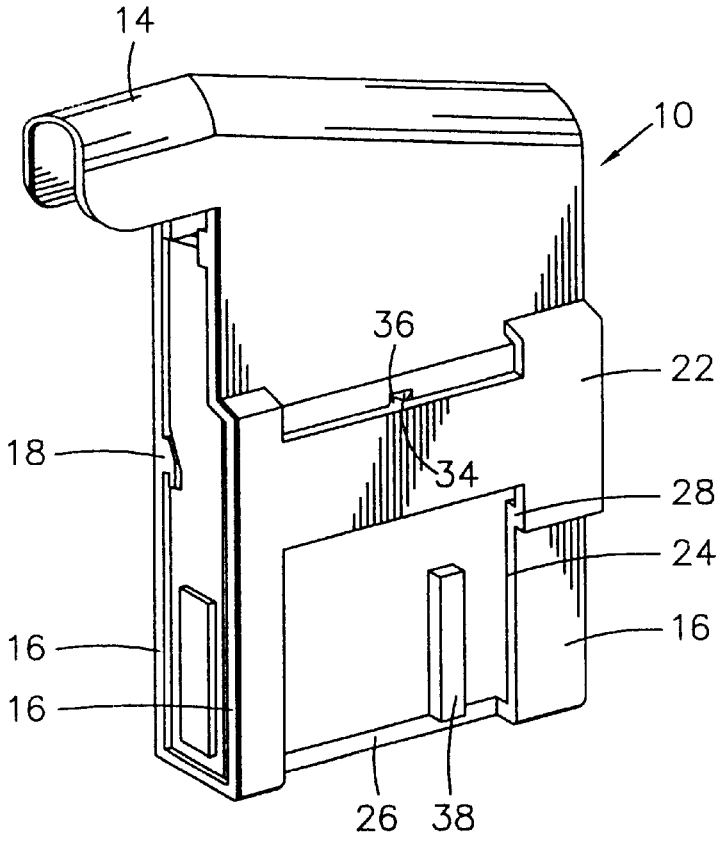
FIG. 2 is a perspective view, similar to FIG. 1, showing the module in place in the casing.

The connector shown in FIGS. 1 and 2 constitutes a plug which can be inserted into a socket. It has a casing 10 and a single module 12. However, the invention would also be applicable to a connector having two modules placed side by side. The casing 10 and the module may each consist of a single moulded part, generally made of a plastic reinforced with fillers.

The casing 10 defines a housing having a guide or cover 14 for entry of a cable and two parallel side walls 16 which define a corridor into which the module 12 is inserted. One of the side walls 16 has a rail 18 intended for locking the contact terminals of the connector, as may be seen later. The rail 18 shown has a cross-section in the form of an upside-down L but this shape is not essential. The wall 16 opposite that provided with the internal rail 18 has, at mid-height, a step 20 causing the corridor to widen out. Below the step, the wall reduces to two uprights parallel to the plug-in direction, these being connected by a beam 22. This beam and the uprights define a window 24 which extends as far as the bottom 26 of the module holder. The bottom 26 is pierced by a row of holes for the passage of terminals.

Below the beam 22, the upright opposite the entrance of the corridor has a new step 28 which brings the width of the corridor back to the same value as above the step 20.

The module 12 has a parallelepipedal general appearance and its thickness corresponds to the width of the corridor above the step 20. It is pierced by cavities 30 for receiving a row of contact terminals. A recess 32, which emerges in the cavities allows the locking rail 18 to pass. The terminals (not shown) which occupy the cavities may be retained by the rail 18 in a manner known from document DE 3,537,722.

On the opposite face of the module from that in which the recess 32 is made, there is a locking projection 34 placed level with the transverse member 22. The projection is sufficient for it to attach onto an internal locking lug 36 provided on the transverse member 22. The transverse member 22 is thin and flexes under the action of the projection 34 in order to allow the projection to snap-fasten onto the lug when the module comes to the end of its insertion travel, as illustrated in FIG. 2.

Means for coding the connector are carried by the module. In the case illustrated in FIGS. 1 and 2, they have a single key 38 projecting from the flat face of the module which carries the locking projection 34. This key may be freely inserted into the casing, as it lies opposite the enlarged part of the corridor.

That face of the module which carries the key 38 and the projection 34 also has, in its rear part, a protuberance 40 which is elongate in the plug-in direction, the longitudinal projection of which corresponds to the increase in the width of the corridor between the steps 20 and 28.

It may be seen that connectors having codes which are very different from each other may all be formed using one and the same type of casing 10.

The way the connector is assembled stems directly from the above description. The contact terminals connected to their wires are placed in the module 12, which will generally include resilient means for primary locking of the terminals, consisting of fingers which are moulded with the module and engage in windows in the contact terminals. Next, the module is slid, in the direction of the arrow $f_0$ of FIG. 1, until it is in the position shown in FIG. 2. The key 38 passes without difficulty behind the uprights. In the course of its movement, the projection 34 bears on the lug 36 and forces the beam 22 to flex until it is snap-fastened. The module is then locked.

Figure 4:
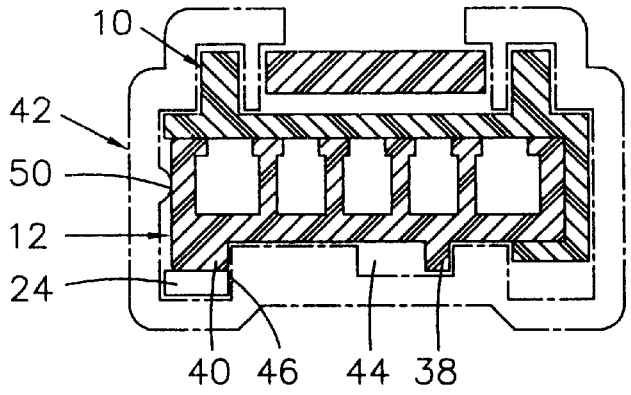
FIG. 4 is a cross-sectional view on the plane IV—IV of FIG. 3.
Figure 3:
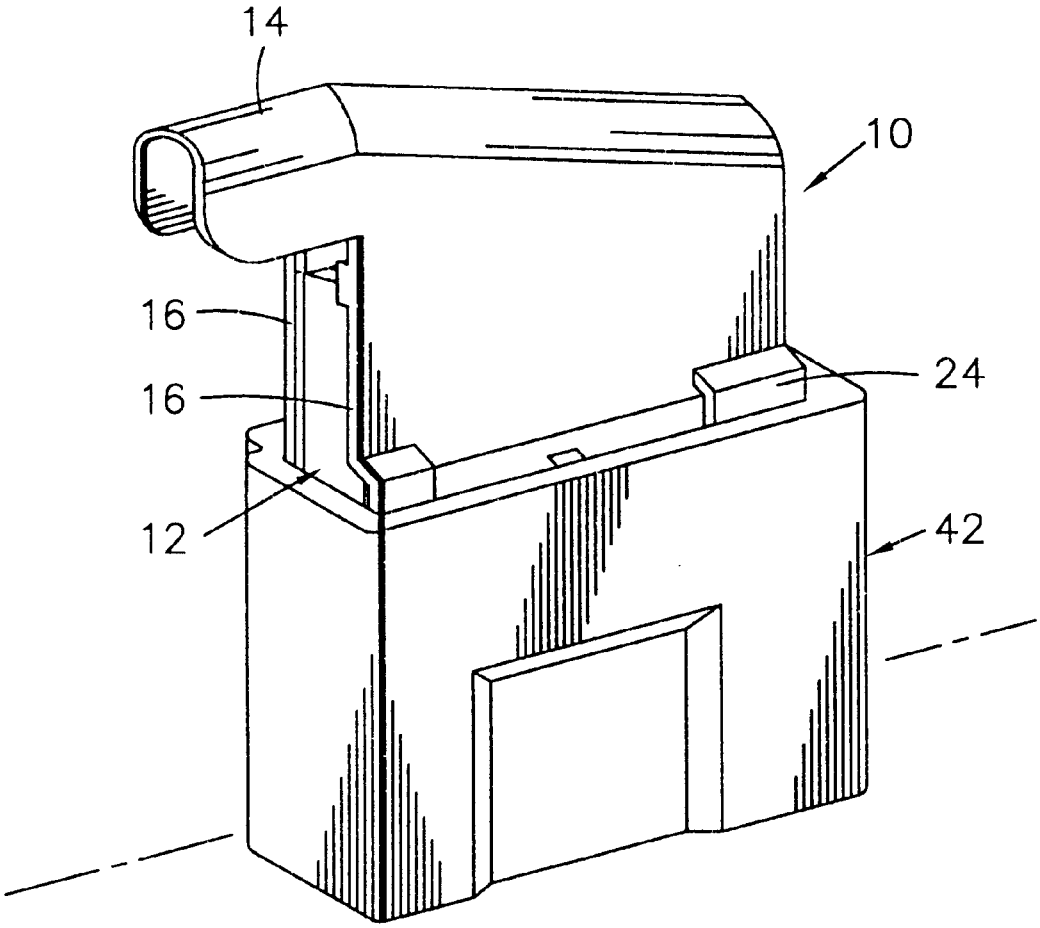
FIG. 3 is a perspective view showing the connector plugged into a socket.

The connector shown in FIGS. 1 and 2 constitutes a plug which may be received in a socket 42 of the kind shown in FIGS. 3 and 4. The bottom part of the socket 42 is provided for receiving male contact terminals, which penetrate the module through the holes made in the bottom 26 of the casing. The cross-section of the internal cavity of the socket 42 corresponds to the cross-section of the casing 10. A groove 44 is provided in order to allow the key 38 of the appropriate connector to pass. Once the plug has been inserted into the socket 42, the clearances necessary for allowing the module to be snap-fastened into the casing may be compensated for by providing a bearing surface of one upright of the casing in the wide part of the corridor, to bear against a shoulder 46 of the socket. In addition, a protuberance 48 may be provided on the module 12 and/or a protuberance 50 may be provided on the internal face of the socket 42 so as to exert a force for holding the module in abutment against the shoulder 46.

These means for reducing the clearance may be replaced by others, for example a flap connected to the casing by a thin portion forming a hinge, which can be folded back above the entry of the corridor and can be fastened in order to hold the module in place.

Figure 5:
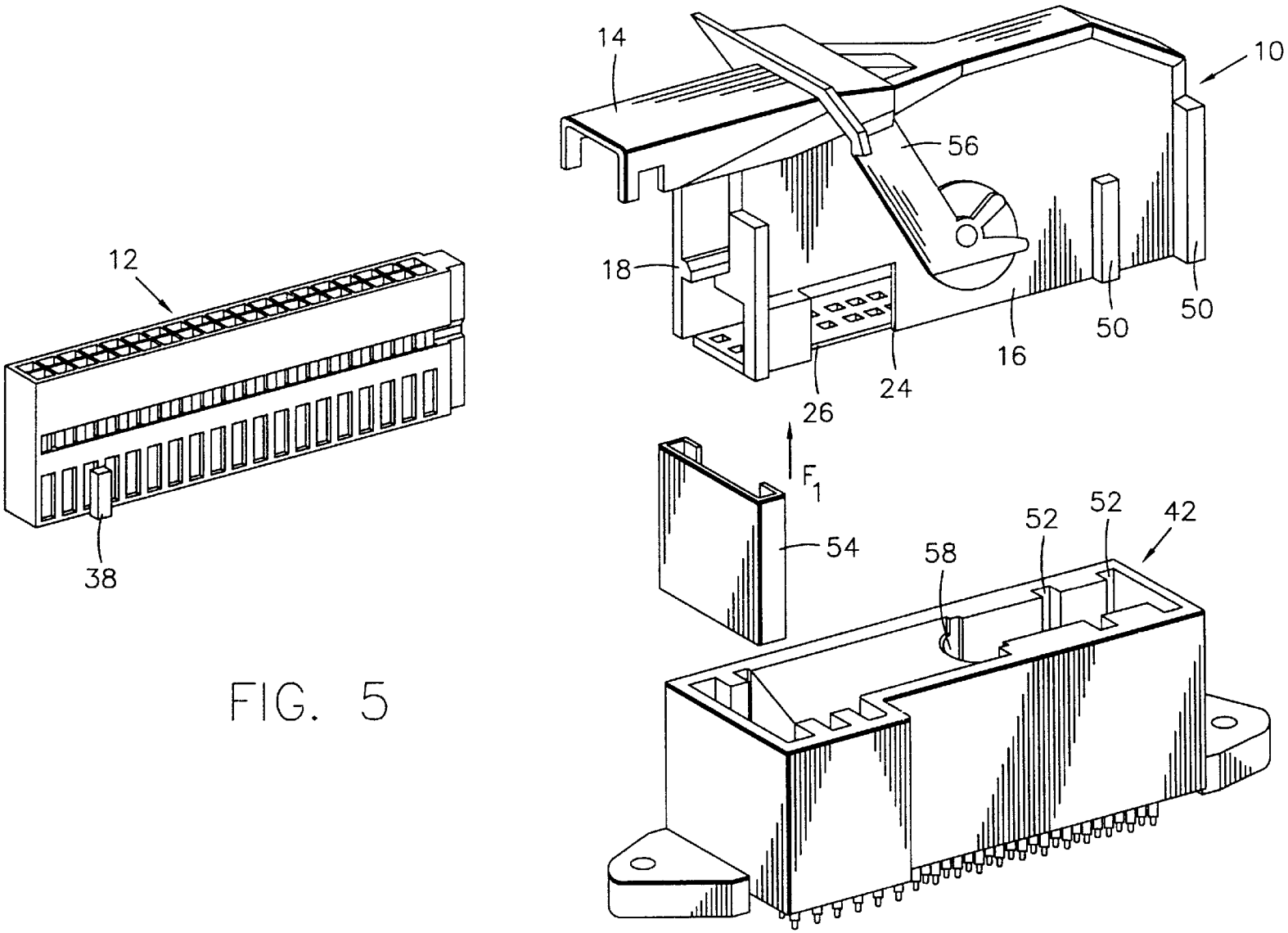
FIG. 5 is a perspective view showing the component parts of a connector and of a socket according to a variant of FIG. 3.

In the embodiment variant shown in FIG. 5, in which the components corresponding to those in FIGS. 1 to 4 bear the same reference number, the casing 10 includes a rocking lever 56 for helping to insert the module, as described in German Utility Model DE G 87 14 016. The side walls 16 include guide keys 50 intended to slide in grooves 52 in the socket. A cover 54 provided with rims allows the corridor to be closed, by inserting it in the direction of the arrow $f_1$ shown in FIG. 4, when the module has been inserted. Finally, the lever 56 makes it possible, by meshing with internal teeth 58 on the socket, to facilitate the plugging-in operation.

I claim:

1. A connector intended to be plugged into a complementary connector by inserting the connector into the complementary connector in a plugged-in direction, said connector comprising a casing (10) having two side walls defining a corridor, transverse to the plug-in direction, and at least one contact-carrying module (12) which can be inserted into the corridor and defines at least one row, parallel to the direction of insertion, of the module, of cavities for receiving contact terminals, characterized in that a window (24) made in at least one of the said walls (16) and in that a flank of the module carries a projecting coding key (38) which is oriented parallel to the plug-in direction and is placed so as to be in the window when the module is in place in the casing.

2. The connector according to claim 1, characterized in that said casing has a bottom and the window (24) extends as far as the front end of the casing in the plug-in direction and into the bottom (26).

3. The connector according to claim 2, characterized in that part of the wall of the casing defines the window and constitutes a flexible beam (22), having on its internal face a locking lug (36) corresponding to a locking projection (34) carried by the module.

4. The connector according to claim 3, characterized in that the side wall (16) of the casing (10) in which the window (24) is made includes a step (20), of height corresponding to the projection (34) of the module, above the level of the beam.

5. The connector according to claim 4, characterized in that the module has, to the rear, in the direction of insertion, a protuberance (40) of height corresponding to that of the step (20).

6. The connector according to claim 5, characterized in that the protuberance (40) has a width substantially equal to an upright part of the wall (16) lying to the rear of the window (24) in the direction of insertion of the module.

7. The connector according to claim 6, characterized in that the module has, to the rear in the direction of its insertion, a region (48) of additional thickness which is intended to serve as a bearing surface when the connector is inserted into a complementary connector.

8. The connector according to claim 1 characterized in that it also includes a cover (54) which can be inserted, by sliding, onto the casing in order to close the entrance of the corridor after the module has been inserted.

9. The connector according to claim 1, characterized in that it comprises a lever pivoted on the casing (56) for aiding the insertion.

10. The connector according to claim 1, characterized in that the module has a recess (32) for receiving a locking rail (18) carried by an internal wall of the casing.

* * * * *